US006957507B2

(12) United States Patent
Ausland et al.

(10) Patent No.: US 6,957,507 B2
(45) Date of Patent: Oct. 25, 2005

(54) DECORATIVE MAGNET AND CASING

(76) Inventors: Kelly Stewart Ausland, 63375 Fawn La., Bend, OR (US) 97701; Elizabeth Brooke Smith, 63375 Fawn La., Bend, OR (US) 97701

( * ) Notice: Subject to any disclaimer, the term of this patent is extended or adjusted under 35 U.S.C. 154(b) by 0 days.

(21) Appl. No.: 10/206,552

(22) Filed: Jul. 25, 2002

(65) Prior Publication Data

US 2004/0016159 A1 Jan. 29, 2004

(51) Int. Cl.[7] ..... G09F 7/04
(52) U.S. Cl. ..... 40/600; 40/621
(58) Field of Search ..... 40/124.04, 358, 40/600, 621, 661.01, 661, 711; 24/303, 66.1; 63/900, 29.2; 248/206.5

(56) References Cited

U.S. PATENT DOCUMENTS 2,431,827 A * 12/1947 Radio ..... 40/621
2,659,169 A * 11/1953 Brennan ..... 40/1.5
4,014,122 A * 3/1977 Woods ..... 40/358
4,040,724 A * 8/1977 Klingler ..... 359/604
4,146,273 A * 3/1979 Spisak ..... 301/37.31
4,236,331 A * 12/1980 Mattson ..... 40/1.5
5,316,376 A * 5/1994 Defreitas ..... 301/37.26
5,347,733 A * 9/1994 Whittington ..... 40/1.5
6,574,897 B1 * 6/2003 Timmer ..... 40/800
6,742,295 B2 * 6/2004 Gross ..... 40/711

* cited by examiner

*Primary Examiner*—Brian K. Green
(74) *Attorney, Agent, or Firm*—Glenn C. Brown

(57) ABSTRACT

A decorative magnet having lens with a generally rounded upper surface, a generally flat lower surface, and a peripheral flange. An image is adhered to the bottom surface of the lens. The lens is mounted in a base having a central recess and a flange that interlockingly engages the peripheral flange of the lens. A small, strong magnet is positioned in the recess. The bottom wall of the base modulates the magnetic field of the magnet, providing a modulated magnetic attachment force.

10 Claims, 2 Drawing Sheets

DECORATIVE MAGNET AND CASING

BACKGROUND OF THE INVENTION

This invention relates to decorative magnets and, in particular, to a decorative magnet that can incorporate and display a variety of decorative images or messages.

Decorative magnetic novelties are well known and widely used as promotional and novelty items. The most common type of decorative magnet includes a planar, flexible magnetic material onto which is mounted or laminated a decorative or promotional image. Another known type of decorative magnet includes a round planar magnet onto which is adhered an image and a clear bubble-like cover. This type of decorative magnet has become more popular, but is relatively expensive to manufacture because of its configuration.

DETAILED DESCRIPTION OF THE INVENTION

Figure 1:
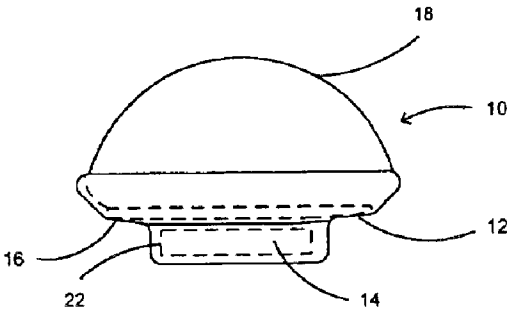
FIG. 1 is a side view of a preferred embodiment of the invention.
Figure 6:
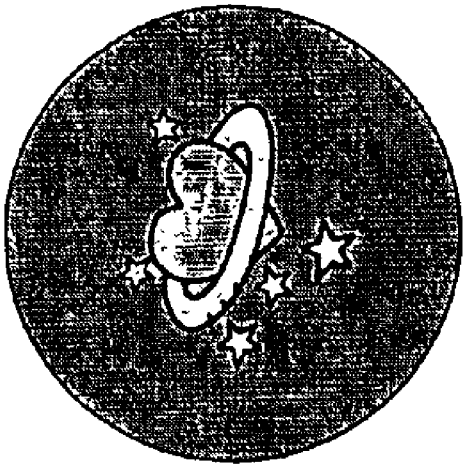
FIG. 6 is a top view of one example of the image bearing portion adhered to the bottom of the lens portion.

Referring now to the drawings, the invention will be described in detail. Referring first to FIG. 1, in a preferred embodiment, the invention shown generally at 10 includes a bezel 12, a magnet 14, an image-bearing sheet of paper or polymeric material 16, and a rounded lens 18. The image bearing sheet 16 (see FIG. 6) is adhered to the bottom surface of the lens 18 with the image facing the lens. Nearly any image or message can be displayed on the image bearing sheet 16, subject only to the size constraints of the lens and base.

Referring to FIG.'s 2–4, bezel 12 includes a base 20 defining a recess 22. A hole 23 is formed in the bottom of recess 22. A flange 24 extends outwardly from the upper portion of base 20 and includes a lateral portion 26 and an upwardly extending portion 28. Portion 28 of flange 24 includes an inwardly folded distal edge that is precisely sized to receive and retain lens 18 as described in greater detail below.

BRIEF SUMMARY OF THE INVENTION

An object of the invention is to provide a decorative magnet comprising a lens and a bezel. The bezel comprises a generally flat bottom wall, a central recess, a lateral flange surrounding the bottom wall and a vertical flange extending upward from the lateral flange. The lens comprises a generally rounded upper surface, a generally planar lower surface, a peripheral flange and an image adhered to the lower surface. A magnet is disposed in the central recess of the bezel. The peripheral flange of the lens is engaged with an inwardly folded distal edge of the vertical flange of the bezel.

A further object of the invention is to provide a decorative magnet assembly that is readily and economically manufactured, and one that provides a secure yet not overly strong magnetic attachment to the underlying metallic surface.

Figure 2:
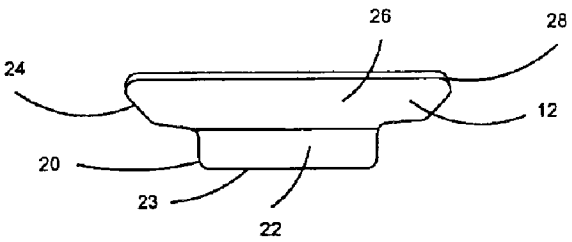
FIG. 2 is a side view of the bezel portion of the embodiment shown in FIG. 1.
Figure 3:
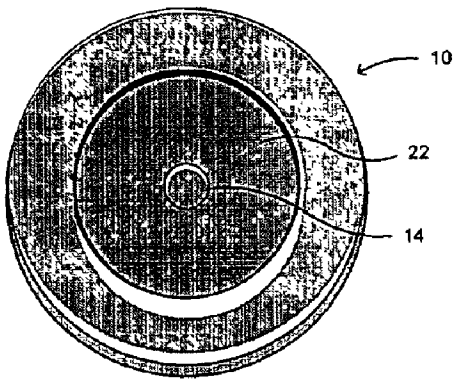
FIG. 3 is a bottom perspective view of the bezel portion of the invention.
Figure 4:
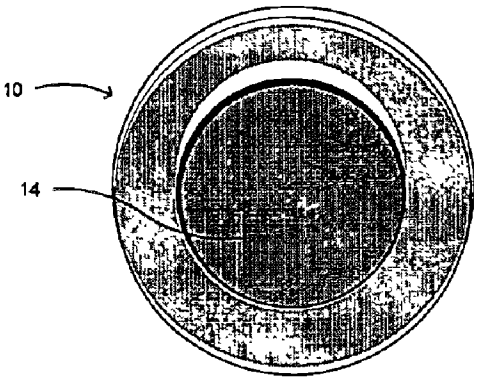
FIG. 4 is a top perspective view of the bezel portion of the invention.

Referring again to FIG. 1, a magnet 14 is located in a recess 22 on FIG. 2. The nature and placement of magnet 14 are key improvements of the invention over the prior art. As mentioned above, prior art decorative magnets incorporate planar magnetic sheets. The magnetic sheets are normally die-cut from large sheets, and are cut to match the size and shape of the lower surface of the lens. While serviceable, the die-cut magnetic sheets are relatively expensive, and must be cut into the desired shape, further adding to their expense. In this invention, applicant has developed an improved alternative that, by virtue of replacing the die-cut magnet, is superior in strength, cleaner in design, and easier to manufacture. The die-cut sheet magnet is replaced in the present invention by a relatively small, powerful neo-dymium magnet 14. While this may seem a readily apparent alternative to the die cut magnetic sheets, the use of such magnets has not been feasible before now. First, such magnets are so strong that if a neo-dymium magnet having the same diameter as the image and lens size were used, it would adhere to a metal surface so strongly that it would be impractical for use as merely a decorative item. In this invention, applicant has incorporated two aspects that permit one to take advantage of the cost savings associated with neo-dymium magnets. First, the invention uses a bezel or base 20 that incorporates a relatively small recess 22 into which a smaller magnet 14 can be mounted. Second, the bezel 20 is made of a magnetically susceptible metal that modulates the strong magnetic field of the neo-dymium magnet 14. The result is that the strong, compact neo-dymium magnet can be incorporated into the assembly, and the assembly attaches firmly, but not too firmly, to a metallic surface. At the same time, the bezel is formed such that the lateral flange 24 and the upper surface of magnet 14 together define a supporting surface that can support the image and lens assembly. Finally, the magnet does not need to be glued to either the lens or the bezel, since it magnetically attaches to the bezel. The result is an assembly that is readily and economically manufactured, and one that provides a secure yet not overly strong magnetic attachment to the underlying surface.

Figure 5:
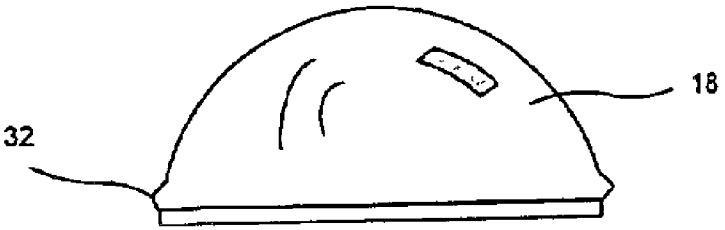
FIG. 5 is a side view of the transparent lens portion of the invention with the image bearing portion adhered to the bottom surface.

Referring to FIG. 5, the lens 18 is a generally hemispheric, molded plastic lens. In the preferred embodiment, the molded lens is formed of an acrylic material, but the invention is not limited to any specific lens material. Any other material having suitable characteristics of formability and clarity can be substituted. The same is true of the shape of the lens, which is not limited to the hemispherical shape illustrated in the preferred embodiment. The lens can also be rounded or have a flat upper surface as well. In a preferred embodiment, lens 18 includes a small peripheral flange 32 that interlocks with flange 24 of base 20 to secure lens 18 to the base with a slight interference or snap fit. This provides an additional advantage over the prior art in that the assembly of the lens, the magnet, and the base is achieved without the need for adhesives.

This invention has been described by reference to the preferred embodiments described above. However, the invention is not intended to be limited to those embodiments. Those skilled in the arts will recognize that numerous modifications to the preferred embodiments can be made without departing from the scope of the following claims.

What is claimed is:

1. A decorative magnetic item comprising:

a bezel having a bottom wall, a central recess, a lateral flange surrounding the central recess, and a peripheral vertical flange extending upward from the lateral flange, the bezel formed of a magnetic field modulating material;

a magnet disposed in the central recess and causing a first magnetic field strength inside the central recess and a second, lower magnetic field strength on the opposite side of the bottom wall from the magnet;

a decorative image overlaying the central recess; and a transparent member disposed overlaying the decorative image and engaged with the lateral flange and the vertical flange, wherein the transparent member includes a bottom surface, and wherein the decorative image is adhered to the bottom surface.

2. A decorative magnetic item according to claim 1 wherein the transparent member bottom surface is substantially flat.

3. A decorative magnetic item according to claim 1 wherein the transparent member includes a rounded upper surface.

4. A decorative magnetic item according to clam 1 wherein the magnet comprises a neo-dymium magnet.

5. A decorative magnetic item according to claim 1 wherein the bezel is formed of a metallic material.

6. A decorative magnetic item comprising:

a bezel having a bottom wall, a central recess, a lateral flange surrounding the central recess, and a peripheral vertical flange extending upward from the lateral flange;

a magnet disposed in the central recess and causing a first magnetic field strength inside the central recess and a second, lower magnetic field strength on the opposite side of the bottom wall from the magnet;

a decorative image overlaying the central recess; and a transparent member disposed overlaying the decorative image and engaged with the lateral flange and the vertical flange, wherein the transparent member includes a bottom surface, and wherein the decorative image is adhered to the bottom surface.

7. A decorative magnetic item according to claim 6 wherein the transparent member bottom surface is substantially fiat.

8. A decorative magnetic item according to claim 6 wherein the transparent member includes a rounded upper surface.

9. A decorative magnetic item according to claim 6 wherein the magnet comprises a neo-dymium magnet.

10. A decorative magnetic item according to claim 6 wherein the bezel is formed of a metallic material.

* * * * *